US005199192A

United States Patent [19]

Kilgore et al.

[11] Patent Number: 5,199,192

[45] Date of Patent: Apr. 6, 1993

[54] CYCLING SHOE AND OUTSOLE WITH ROTATABLE CLEAT

[75] Inventors: Bruce J. Kilgore, Lake Oswego; Thomas P. Allen, Beaverton; Perry W. Auger, Tigard, all of Oreg.

[73] Assignee: Nike, Inc., Beaverton, Oreg.

[21] Appl. No.: 539,891

[22] Filed: Jun. 14, 1990

[51] Int. Cl.[5] ..... A43B 05/14

[52] U.S. Cl. ..... 36/131; 74/594.6

[58] Field of Search ..... 36/131, 113, 62, 134; 74/594.6

[56] References Cited

U.S. PATENT DOCUMENTS

| | | | |
|---|---|---|---|
| 1,991,855 | 2/1935 | Johnson . | |
| 3,680,231 | 8/1972 | Dymond | 36/113 |
| 4,298,210 | 11/1981 | Lotteau et al. . | |
| 4,377,952 | 3/1983 | Gamondes . | |
| 4,686,867 | 8/1987 | Bernard et al. . | |
| 4,739,564 | 4/1988 | Eser . | |
| 4,807,372 | 2/1989 | McCall . | |
| 4,815,222 | 3/1989 | Eisenbach et al. . | |
| 4,815,333 | 3/1989 | Sampson . | |
| 4,825,565 | 5/1989 | Bigolin . | |
| 4,827,633 | 5/1989 | Feldstein | 36/131 |
| 4,827,797 | 5/1989 | LeFaou et al. | 36/131 |
| 4,864,887 | 9/1989 | Rapisarda | 36/131 |
| 4,876,808 | 10/1989 | Hsieh | 36/131 |
| 4,882,946 | 11/1989 | Beyl | 36/131 |
| 4,890,507 | 1/1990 | Farris et al. . | |
| 4,893,420 | 1/1990 | Bezin et al. | 74/594.6 |
| 4,898,063 | 2/1990 | Sampson . | |
| 5,079,968 | 1/1992 | Starner . | |

FOREIGN PATENT DOCUMENTS

| | | |
|---|---|---|
| 0193472 | of 0000 | European Pat. Off. . |
| 3315282A1 | of 0000 | Fed. Rep. of Germany . |
| 3329993 | 10/1984 | Fed. Rep. of Germany . |
| 7823423 | of 0000 | France . |
| 8319435 | of 0000 | France . |
| 2279607 | 2/1976 | France . |
| 2609270 | 7/1988 | France . |
| 183582 | 10/1980 | Italy . |
| 8707120 | 12/1987 | PCT Int'l Appl. . |
| 2202499 | 9/1988 | United Kingdom . |

OTHER PUBLICATIONS

Zahradnik "Custom Pedals," Bicycling, Apr. 1990; p. 42.

"It's Time to Look Again", Bicycle Buide, Mar. 1990, p. 55.

Berto, "A Pedal Revolution," Bicycling, Apr. 1989, pp. 172-177, 180-182.

"Here Why More Than 100 Top Pros Ride With Time," Bicycling Guide, Mar. 1990, p. 59.

Design News, Mar. 3, 1988, p. 24.

Design News, Nov. 23, 1987, p. 45.

TC-LITE, TC, CC-X, VT-X, FATZ, CC and SC-X, p. 78, Nike Fall 1989 Catalog.

TC LITE, CC-X, VT-X, FATZ, CC and SC-X, p. 84, Nike Spring 1989 Catalog.

*Primary Examiner*—Steven N. Meyers

*Attorney, Agent, or Firm*—Banner, Birch, McKie & Beckett

[57] ABSTRACT

A cycling shoe and outsole with a rotatable cleat are disclosed. The outsole includes a thin, rigid outsole plate and a thin, flat, cleat support plate that partially extends beyond the perimeter border of the outsole plate. The cleat is configured to detachably attach to and release from a clipless pedal. A mechanism connects the cleat to the cleat support plate in a transversely off-center position, and in a manner which permits limited rotatability between the cleat and the support plate.

26 Claims, 4 Drawing Sheets

CYCLING SHOE AND OUTSOLE WITH ROTATABLE CLEAT

TECHNICAL FIELD

The invention relates to a cycling shoe and in particular an outsole with a cleat support surface which rotatably supports a cycling cleat in an off-center position.

BACKGROUND OF THE INVENTION

When pedaling a bicycle in a normal manner with the rider's shoes not attached to the pedals, the pedaling force to rotate the bicycle drive wheel is only provided during about half the 360° of movement of each pedal. That is, first one pedal is providing the basically downward thrust to rotate the pedal sprocket while the other pedal is moving upward without any driving force being provided, then the situation is reversed as the other pedal is moved downward. These alternating forces by the opposite pedals are satisfactory for much bicycling activity. However, it is well known that it is much more efficient to propel a bicycle if each pedal is providing thrust throughout the entire 360° of rotation for each of the pedals.

Bicycle racers as well as some recreational bicyclists attach their shoes to the pedals to enable the application of force throughout the entire 360° rotation. There are two main methods for attaching the shoes to the pedals. The most common approach is to use a toe clip and strap which cups the toe of the show and straps it to the pedal. Often a cleat is also used to prevent the shoe from sliding rearwardly out of the toe clip. A newer connecting arrangement incorporates a quick release type of tab and groove or cleat and pedal system. In this system the bottom portion of the shoe contains either tabs, grooves or a cleat which mate with corresponding grooves, tabs or cleat coupling structure, respectively, mounted on the bicycle pedal. This system allows for quick secure attachment to a pedal without the encumbrance of the traditional toe clip and strap system which requires loosening the toe clip strap for pedal entry and tightening the strap for a secure fit and optimum pedaling efficiency. With the quick release binding system, the rider merely twists or slides his or her foot in or out of the pedal for secure fastening without the use of a toe clip.

In order to assure maximum pedaling efficiency throughout the 360° rotation of the bicycle pedal, and also to assure a secure connection between the outsole and the pedal, the outsole plates of cycling shoes used in quick-release cleat and pedal systems are frequently formed of a rigid material. In order to assure comfort to the foot overlying such a rigid outsole plate, the outsole plate is frequently contoured to approximately follow the bottom of a typical foot in the area of the ball of the foot. The outsole is thus curved. The curvature of the outsole in the area of the ball of the foot inhibits the ability of mounting cleats in a manner that maximizes both pedaling efficiency and safety. That is, it is desirable to position a cleat to the medial side of the shoe from both the pedaling efficiency standpoint and the safety standpoint. In order to prevent an injury from contact with the bicycle frame, it is desirable to position the feet on the pedal a distance away from the bike frame. In order to maximize pedaling efficiency, it is desirable to apply pedaling force at approximately the first metatarsal head. It is thus desirable to locate the center of a cycling cleat about the first metatarsal head cleat. However, such off-center positioning of a cleat can result in the cleat extending past the medial border of the outsole plate. Such an unsupported portion of the cleat results in instability, and defeats the purpose of enhancing pedal efficiency. Cyclists frequently use shims or wedges between the curved bottom of the outsole plate and the cleat in an attempt to provide additional support and stability to the off-center positioned cleat. The curved bottom of the outsole plate follows the curvature of the foot, and thus the arc of the curve changes from small to large shoe sizes, with the arcs in the smaller sizes having a smaller radius of curvature. The smaller arc of the sole in small shoe sizes requires that the curved portion be thicker in order to retain rigidity, thus adding additional weight.

It is also desirable, for safety purposes, to allow a limited degree of rotatability for the foot during pedaling in order to relieve stresses on the ankle and knee joints. Again, the typical curvature of a rigid outsole cycling plate makes it difficult to address this safety concern since rotatability of the cleat cannot be provided for along the curved outsole plate. This problem has been addressed in pedal designs wherein limited rotatability is provided between the cleat and the bicycle pedal. However, such rotatability frequently complicates the pedal and cleat design. This is particularly true when a cleat is designed to be released by means of a rotary or twisting motion of the foot.

U.S. Pat. No. 4,686,867 to Bernard et al. is an example of clipless pedal designed to enhance pedaling efficiency. A bicycle pedal has a somewhat triangularly shaped pedal body which revolves about a pedal axis. A triangular cleat is connected rigidly to the cyclist's shoe and is designed to be inserted into a recess in the pedal body. The interface surface of the cleat is contoured to complement the contour of the curved outsole. Such a requirement for contouring makes it difficult to secure the cleat to the outsole in an off-center and stable manner. Having a rigid connection between the cleat and the shoe is also disadvantageous because any lateral or twisting movement of the shoe starts to disengage the cleat from the pedal. Therefore the cyclist must try to maintain his foot in a stationary alignment to keep the cleat in the fully engaged position on the pedal. As mentioned above, stresses on the ankle and knee joints thus can occur.

U.S. Pat. No. 4,815,333 to Sampson discloses an integrated bicycle pedal system with self-centering and lateral release capabilities which permits a limited degree of rotatability between the cleat and pedal during pedaling motion. The system consists of a cleat rigidly attached to the cyclist's shoe having two downward projections. These projections feature arcuate tracts for matingly engaging the cleat to a pedal body. The pedal body contains a biasing mechanism centered in the back of the pedal body. The cleat and the pedal body are configured so that the cleat rotates within a channel in the pedal body. The channel is designed to re-center the cleat in its optimum or central position after encountering torsional shocks or other motions. This re-centering capability is provided by the biasing mechanism which becomes increasingly compressed as the cleat is moved further from the central position. The centering function is provided by the spring used for securing the cleat to the pedal, so that the spring must have a high spring rate. Thus, although the cleat may be rotated without partially disengaging the cleat from the pedal, the cyclist will feel the effect of the biasing mechanism biasing the foot back toward the central position. Such a strong biasing force defeats the purpose of allowing limited cleat rotatability since stress is still placed on the ankle and knee joints.

The prior art fails to contemplate a cycling shoe and cleat wherein the cleat can be stably supported on a flat surface in an off-center position and wherein the cleat can be pivotally connected to the outsole in a manner which allows the cyclist to move his foot and the shoe without either partially disengaging the cleat from the pedal or encountering a biasing force from a biasing mechanism sufficient to create discomfort.

SUMMARY OF THE INVENTION

The invention relates to a cycling shoe outsole which is formed of a rigid outsole plate and a rigid cleat support plate. The outsole plate has a curved contour approximating the bottom curvature of a foot and an outer perimeter border to which a cycling shoe upper can be attached. The cleat support plate is located in the ball area of the outsole and has a flat surface to which a cycling cleat can be attached. At least a portion of the cleat support plate extends laterally beyond the perimeter border of the outsole plate on the medial side of the outsole.

The outsole plate and cleat support plate are preferably formed of a single integral piece of plastic material. Such an outsole configuration disassociates the curved contour necessary to produce a good fitting sole and upper from the optimum surface for interfacing a cleat with a pedal, i.e. a flat surface. This overcomes the disadvantages discussed above in attempting to properly locate a cleat on a rigid curve bottom outsole. That is, since the flat surface of the outsole plate extends beyond the perimeter border of the outsole plate on the medial side of the outsole, a cleat can be affixed to the cleat support plate in an off-center (preferably about the first metatarsal head) position in a stable manner. The foot can thus be positioned in a safer and more pedaling efficient location.

The use of a flat cleat support plate allows the outsole of the present invention to accomplish another important advantage over prior cycling shoes, i.e. the rotatability of the cleat with respect to the outsole. Thus, a preferred embodiment of the invention also includes a cycling shoe and cleat system wherein a mechanism connects a cleat to the flat outsole plate in such a manner to provide limited rotatability, preferably in the range of approximately six degrees to either side of a center point. This limited degree of rotatability relieves stress on the ankle and knee joints during normal pedaling motion, while allowing the cleat to remain fixed within a conventional clipless pedal, such as a Look or Shimano pedal. The limited rotatability is accomplished without requiring a complicated pedal design.

Another advantage of providing a flat cleat support surface is that shims can be added between the cleat and the outsole plate to accomplish a varus or valgus cant. The invention avoids the problem of thicker curved sole portions in smaller sizes by the use of the flat cleat support plate, which lends support to the curved portion of the outsole plate without adding additional thickness and weight.

Various advantages and features of novelty which characterize the invention are pointed out with particularity in the claims annexed hereto and forming a part thereof. However for a better understanding of the invention, its advantages, and objects obtained by its use, reference should be had to the drawings which form a further part hereof, and to the accompanying descriptive matter, in which there is illustrated and described preferred embodiments of the invention.

DETAILED DESCRIPTION OF THE INVENTION

Figure 1:
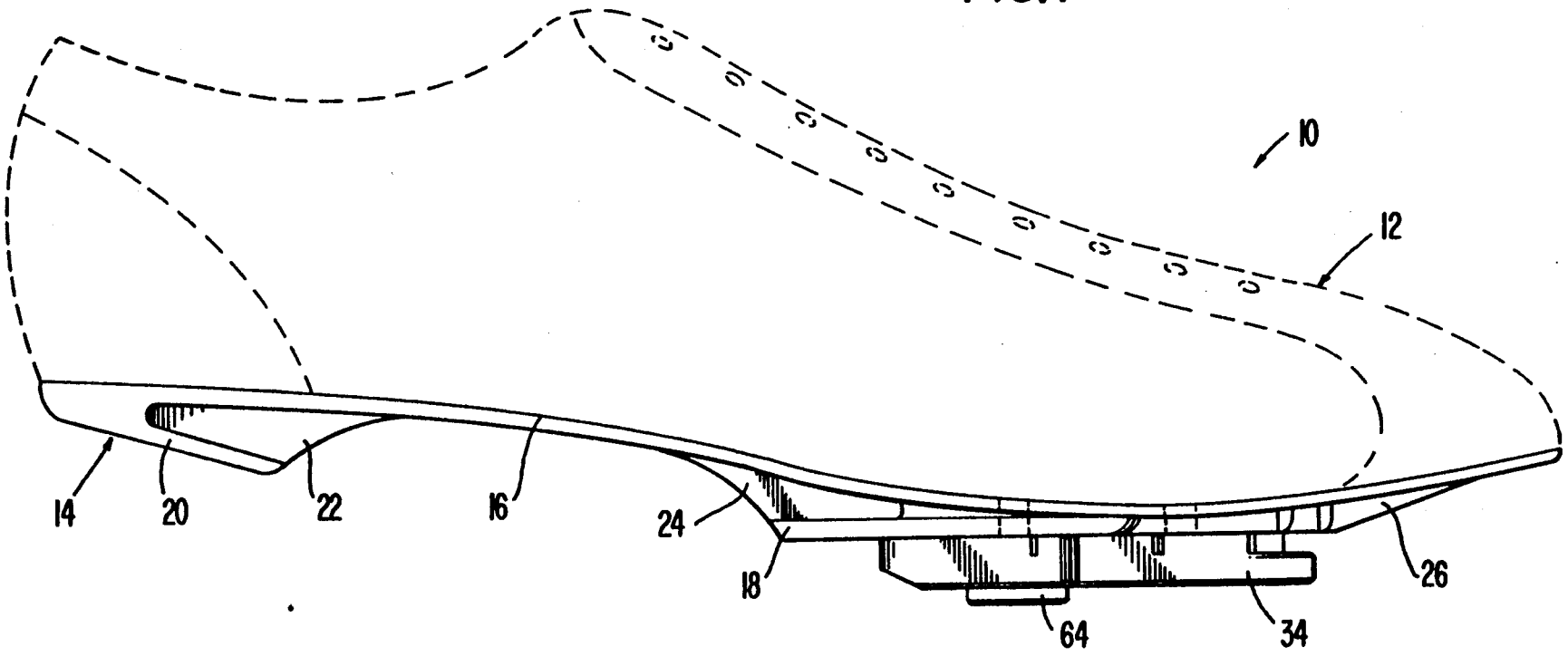
FIG. 1 is a side elevational view of the cycling shoe embodying the present invention.

Referring to the drawings, wherein like numerals indicate like elements, a cycling shoe 10 in accordance with the present invention is shown in FIG. 1. Shoe 10 includes an upper 12 attached to a rigid outsole 14 in a conventional manner such as with an adhesive. Upper 12 can be made of conventional materials and be of a conventional design typical of cycling shoe uppers.

Outsole 14 includes an outsole plate 16, which extends along the entire length of outsole 14, and a cleat support plate 18 located in the forefoot area of outsole 14. Outsole plate 16 takes on a curved configuration, particularly in the ball area of the foot, which approximates the curvature of a typical foot. In contrast, cleat support plate is formed with a flat lower, cleat engaging surface. In the heel area, outsole plate 16 includes a heel projection 20 extending downwardly from the major plane of plate 16. For strengthening purposes, a longitudinal rib 22 extends between heel projection 20 and the lower surface of outsole plate 16. Longitudinal strengthening ribs 24 and 26 similarly extend between the lower surface of outsole plate 16 and the upper surface of cleat support plate 18. An additional transversely extending rib 28 extends between the lower surface of outsole plate 16 and the upper surface of cleat support plate 18. Plates 16, 18 and strengthening ribs 22, 24, 26 and 28, are preferably formed of a single integral piece of material, and can be made of any conventional rigid plastic material having the durability to withstand pedaling action and walking motion. A preferred material is a glass-filled polyurethane, and other suitable materials would be 30% glass filled nylon 12. Outsole plate 16 and cleat support plate 18 are made relatively thin, e.g. 3.8 mm. and 5.0 mm. respectively, in order to reduce the weight of the cycling shoe.

Figure 5:
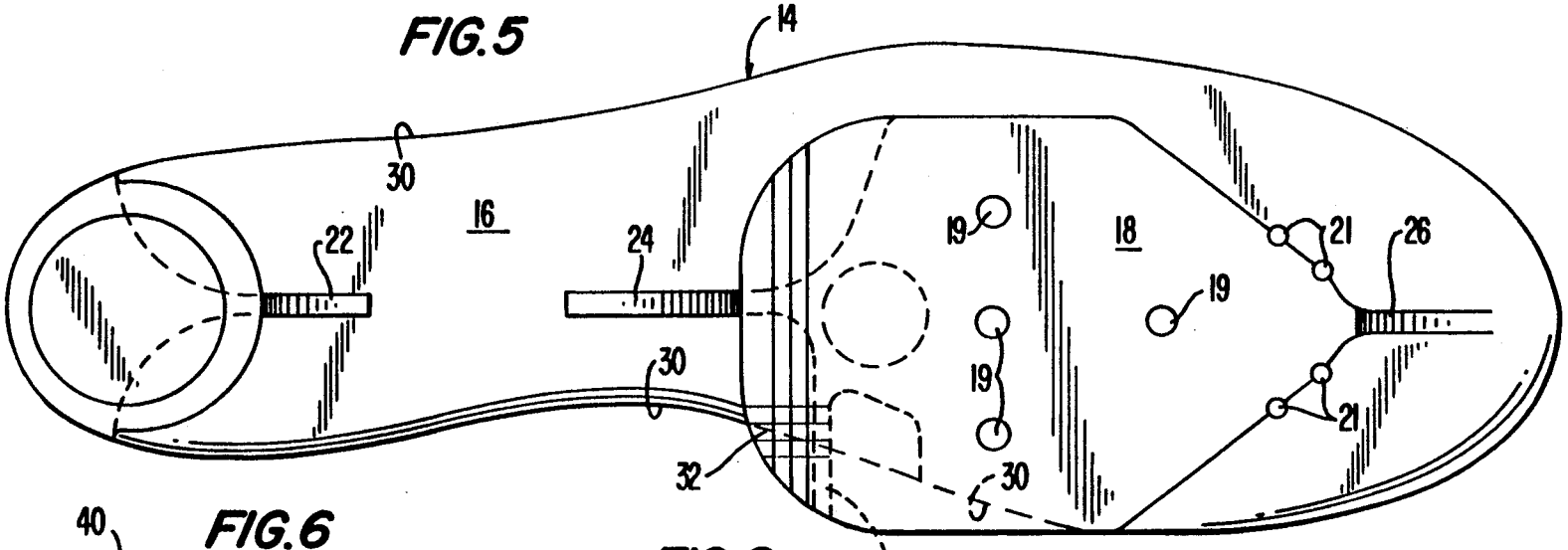
FIG. 5 is a bottom plan view of the outsole.

Outsole plate 16 includes a perimeter border 30, which forms the outermost extent of outsole 14 to which upper 12 is attached. As best seen in FIG. 1, cleat support plate 18 has a flat lower or outer surface which departs from the outer curvature of outsole plate 16 in the ball area of the shoe. Furthermore, as best seen in FIG. 5, the medial edge of cleat support plate 18 extends transversely past the perimeter border 30 (shown in dash-line) of outsole plate 16. Extending outsole plate 16 beyond perimeter border 30 allows a cleat to be attached to outsole 12 in an off-center position and in a stable manner, without the requirement of additional shims. Threaded holes 19 are formed in cleat support plate 18 to receive threaded bolts for securing a cleat to the outsole. A plurality of vent holes 21 are formed completely through the outsole plate for ventilation purposes.

Grid shaped indicia 32 are formed along the bottom flat surface of cleat support plate 18. For purposes of simplicity indicia 32 are only illustrated in the lower left hand portion of outsole plate 18 in FIG. 5, it being understood that the indicia would cover the cleat interface area of cleat support plate 18. Indicia 32 is used to provide an indication and guide for positioning different cleats to additional pairs of shoes. That is, once a preferred location for a cleat is determined by an individual, such location can be determined from the indicia for the placement of other cleats on the outsoles of additional pairs of shoes which also use the indicia. This is an advantage for professional level cyclists, as the majority use multiple pairs of shoes for varied levels of performing and training, and previously had to spend considerable time determining the preferred location of their cleats. Indicia 32 are preferably molded on cleat support plate 18.

Figure 8:
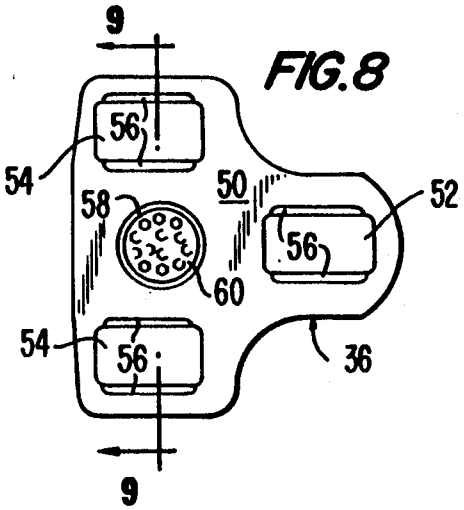
FIG. 8 is a top plan view of the washer.
Figure 9:
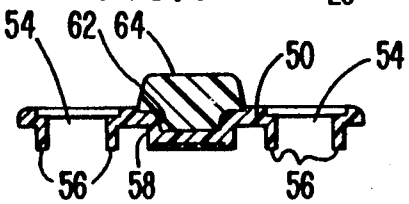
FIG. 9 is a cross-sectional view of the washer taken generally along line 9—9 of FIG. 8.
Figure 7:
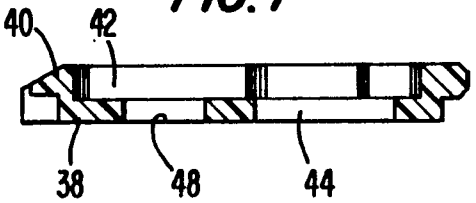
FIG. 7 is a cross-section view of the cleat taken generally along line 7—7 of FIG. 6.
Figure 6:
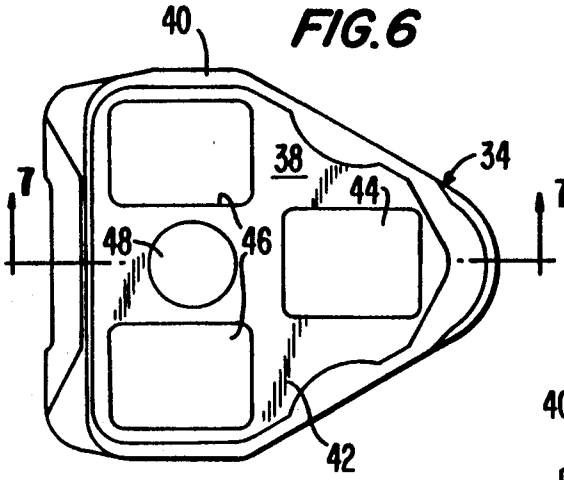
FIG. 6 is a bottom plan view of the cleat.

The flat lower surface of cleat support plate 18 forms an appropriate surface to which a cleat for use in clipless cycle pedaling systems can be rotatably attached. Such a cleat 34 is shown in plan view in FIG. 6. A washer 36 for securing cleat 34 to plate 18 is shown in plan view in FIG. 8. Cleat 34 has a generally triangular shape designed to mate with a conventional Look or Shimano pedal. Cleat 34 includes a base 38 and a wall 40 extending around the perimeter of base 38. A recess 42 is thus formed between the inner surface of wall 40 and the lower surface of base 38, and defines the area within which washer 36 is received. A forward rectangular opening 44, a pair of rear rectangular openings 46 and a circular opening 48 are formed through base 38 of cleat 34.

Washer 36 includes a base 50 through which is formed a front rectangular opening 52 and a pair of rear rectangular openings 54. A projection, in the form of a flat flange 56 extends upward (relative to the direction in which washer 36 is secured to plate 18) from each transverse side of each opening 52 and 54. A circular projection or boss 58 extends upward from base 50 in the area between openings 54. A recess is formed within boss 58 within which a high friction material is received. A preferred high friction material is an abrasive sheet metal sold under the trademark of DRAGON-SKIN. The high friction material assists in holding washer 36 in position on plate 18. On the lower side of base 50, a recess 62 is formed in substantial alignment with boss 58. A generally rectangular shaped anti-skid pad 64 for engaging a pedal is received in and attached to recess 62.

Figure 2:
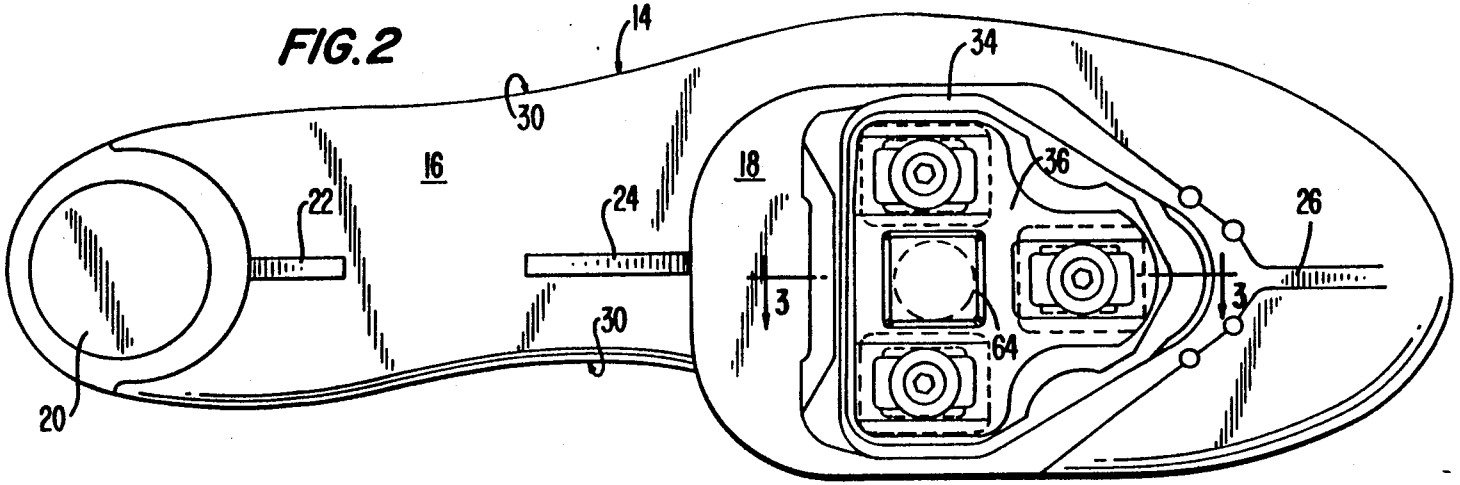
FIG. 2 is a bottom plan view of the outsole and cleat illustrated in FIG. 1, with the upper removed.
Figure 3:
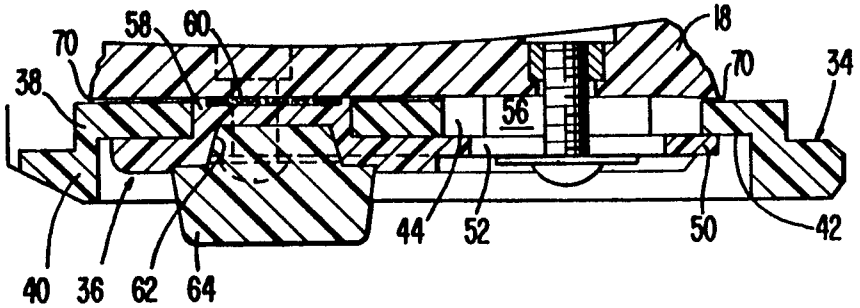
FIG. 3 is a cross-sectional view of the outsole and cleat taken along line 3—3 in FIG. 2.

Referring in particular to FIGS. 2 and 3, the manner of securing cleat 34 to cleat support plate 18 is illustrated. The spacing between opposed transverse sides of openings 44 and 46 in cleat 34 is greater than the spacing between the outer transverse sides of flanges 56 so that flanges 56 fit within openings 44 and 46 with a limited degree of play. Projection 58 from washer 36 similarly freely fits within opening 48 of cleat 34. Cleat 34 is placed against support plate 18 and washer 36 is located within recess 42. This overlying relationship is illustrated in FIG. 3. Also as seen therein the cleat and washer are secured in position by means of bolts 66 received within threaded openings 19 in cleat support plate 18. A circular washer 68 is disposed around each bolt 66 and is located between the head of bolt 66 and the lower surface of base 50. The lengthwise extent of the rectangular openings in the cleat and washer allow the longitudinal position of the cleat to be adjusted.

Figure 4:
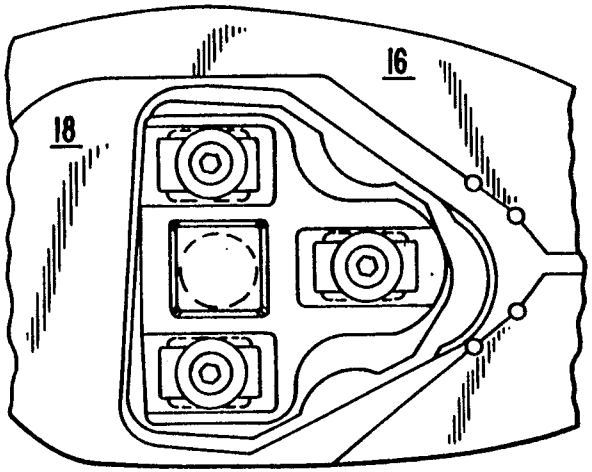
FIG. 4 is a bottom plan view of the forefoot area of the outsole illustrating the cleat in a rotated position.

As best seen in FIG. 3, the thickness or height of flanges 56 and projection 58 of washer 36 is greater than the thickness of base 38 of cleat 34. A slight gap 70 thus remains around the base of cleat 34 and between washer 36 and cleat support plate 18 after washer 36 is secured in place by bolts 66. In this manner, washer 36 is firmly secured in position on plate 18, while cleat 34 is permitted a limited degree of rotary motion to the left and right of a center point shown in FIG. 2. FIG. 4 illustrates cleat 34 rotated to the right. This rotation of cleat 34 is limited by the contact of the perimeter of base 50 of washer 36 with the interior of perimeter wall 40 of cleat 34. Rotation can also be limited by contact of flanges 56 with the opposite transverse sides of front opening 44 in cleat 34. A preferred range of limited rotation is 6° to either side of a center alignment point. It has been found that such limited rotation is sufficient to relieve stress on ankle and knee joints, while not being so excessive as to cause problems in pedaling efficiency.

Figure 10:
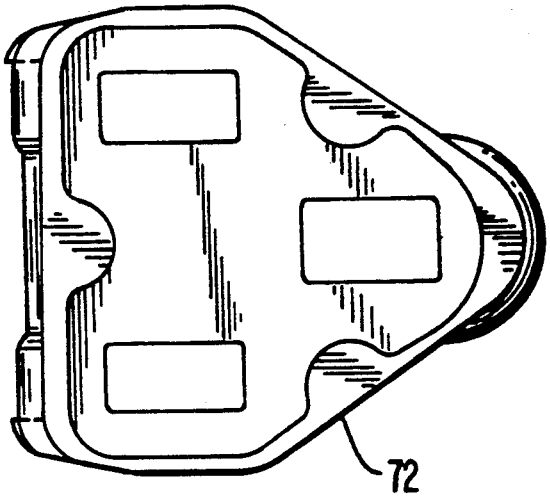
FIG. 10 is a plan view of a non-rotatable cleat.
Figure 11:
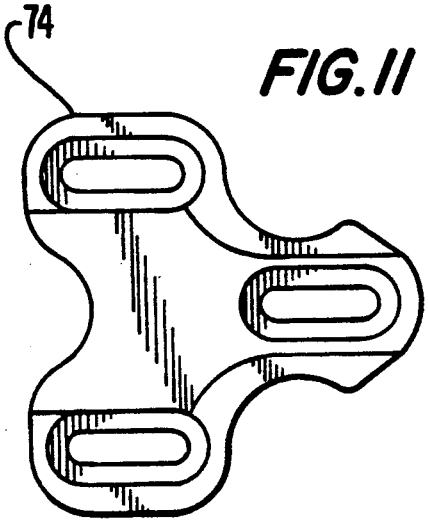
FIG. 11 is a plan view of a washer for use with the non-rotatable cleat.

A cleat 72 and a washer 74 are shown in plan view in FIGS. 10 and 11. Cleat 72 and washer 74 are also adapted for use in a Look/Shimano pedal. However, cleat 72 is secured in a non-rotatable position by washer 74 simply by a plurality of bolts and washers passing through aligned openings in cleat 72 and washer 74, in a conventional manner. The lower surface of either of the washers, and the heel projection can include a rubber-like coating which would enhance friction with a surface on which a cyclist walks.

Numerous characteristics, advantages, and embodiments of the invention have been described in detail and the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

We claim:

1. A cycling shoe outsole comprising a rigid outsole plate and a rigid cleat support plate, said outsole plate having a curved contour approximating the bottom curvature of a foot in at least the ball area and an outer perimeter border to which a cycling shoe upper is to be attached, said cleat support plate being located in the ball area of the outsole and having a flat surface to which a cycling cleat is to be attached, and at least a portion of said cleat support plate extending laterally beyond said perimeter border of said outsole plate on the medial side of said outsole.

2. A cycling shoe outsole in accordance with claim 1 wherein said outsole plate and said cleat support plate are formed of a single integral piece of plastic material.

3. A cycling shoe outsole in accordance with claim 2 wherein said outsole plate and said cleat support plate are formed of glass-filled polyurethane material.

4. A cycling shoe outsole in accordance with claim 1 or 2 including means for connecting a cycling cleat to said cleat support plate which allows a limited degree of rotary motion between the cleat and said cleat support plate during pedaling motion of a bicycle.

5. A cycling shoe outsole in accordance with claim 4 wherein said connecting means includes a washer for overlying a portion of the cleat to be supported and attachment means for removably attaching said washer to said cleat support plate.

6. A cycling shoe outsole in accordance with claim 5 wherein said washer includes stop means for limiting the rotary motion of the cleat with respect to said cleat support plate during pedaling motion of a bicycle.

7. A cycling shoe outsole in accordance with claim 5 wherein said washer includes at least one projection extending from its upper surface, said cleat having an opening through which said projection extends, said at least one projection having a thickness correlated to the thickness of the cleat so that with said washer overlying the cleat and attached to said cleat support plate a gap exists between the cleat and the overlying surface of said washer to permit the limited rotatability of the cleat.

8. A cycling shoe outsole in accordance with claim 1 or 2 wherein the lower surface of said cleat support plate includes grid-shaped indicia.

9. A cycling show outsole in accordance with claim 2 wherein, in the ball area, the lower surface of said outsole plate includes a curved portion from which said cleat support plate extends.

10. A cycling show outsole in accordance with claim 9 wherein at least one support rib extends between the lower surface of said outsole plate and an upper surface of said cleat support plate.

11. A cycling shoe comprising an upper, an outsole attached to said upper and a cleat rotatably attached to said outsole, said outsole including a rigid outsole plate and a rigid cleat support plates, said outsole plate having a curved contour approximating the bottom curvature of a foot in at least the ball area and an outer perimeter border to which said upper is attached, said cleat support plate being located in the ball area of the outsole and having a flat surface to which said cleat is attached, at least a portion of said cleat support plate extending laterally beyond said perimeter border of said outsole plate on the medial side of said outsole, and means for connecting said cleat to said cleat support plate which allows a limited degree of rotary motion between said cleat and said cleat support plate after said cleat has been connected to said cleat support plate.

12. A cycling show in accordance with claim 11 wherein said outsole plate and said cleat support plate are formed of a single integral piece of plastic material.

13. A cycling shoe in accordance with claim 11 wherein said connecting means includes a washer for overlying a portion of said cleat and a plurality of screws extending through holes in said washer and said cleat for connection to threaded holes in said body.

14. A cycling shoe in accordance with claim 13 wherein flanges extend upward from opposite transverse sides of at least one of the holes in said washer and are received within a mating one of said holes in said cleat, said flanges having a thickness correlated to the thickness of said cleat so that with said washer overlying said cleat and attached to said cleat support plate a gap exists between said cleat and the overlying surface of said washer to permit the limited rotatability of said cleat.

15. A cycling shoe outsole and cleat system comprising: a rigid body for connection to a cycling shoe upper, said rigid body including a flat cleat mounting surface, a cleat for coupling to a clipless cycling pedal, connecting means for connecting said cleat to said cleat support surface which allows a limited degree of rotary motion between said cleat and said cleat support surface after said cleat has been connected to said cleat support surface; and wherein said rigid body includes an outsole plate and a cleat support plate, said outsole plate having curved contour approximating the bottom curvature of a foot in at least the ball area and an outer perimeter border to which a cycling shoe upper is to be attached, said cleat mounting surface being formed as the lower surface of said support plate, said cleat support plate being located in the ball area of the outsole and at least a portion of said cleat support plate extending laterally beyond said perimeter border of said outsole on the medial side of said outsole.

16. A cycling shoe outsole and cleat system in accordance with claim 15 wherein said connecting means includes a washer overlying a portion of said cleat and attachment means for removably attaching said washer to said rigid body.

17. A cycling shoe outsole and cleat system in accordance with claim 16 wherein said cleat has a recessed portion within which said washer is received and said attachment means includes a plurality of screws extending through holes in said washer and said cleat for connection to threaded holes in said body.

18. A cycling shoe outsole and cleat system in accordance with claim 17 wherein said washer includes an upper surface with a high friction material located in a portion thereof, said cleat having an opening through which the high friction material of said washer extends to be placed in contact with said rigid body when said cleat is secured in position.

19. A cycling shoe outsole and cleat system in accordance with claim 18 wherein said cleat and washer each have a generally triangular configuration, said holes in said cleat and washer include a pair of rear holes and a forward hole, and said high friction material is located in the area between said rear holes.

20. A cycling shoe outsole and cleat system in accordance with claim 19 wherein said high friction material is supported on a circular projection extending from said washer through a circular hole in said cleat.

21. A cycling shoe outsole and cleat system in accordance with claim 17 wherein said washer includes at least one projection extending from its upper surface, said cleat having an opening through which said projection extends, said at least one projection having a thickness correlated to the thickness of said cleat so that with said washer overlying said cleat and attached to said body by said screws a gap exists between said cleat and the overlying surface of said washer to permit the limited rotatability of said cleat.

22. A cycling shoe outsole and cleat system in accordance with claim 21 wherein said at least one projection includes flanges extending upward from opposite transverse sides of at least one of the holes in said washer and are received within a mating one of said holes in said cleat, the spacing between said flanges being less than the spacing between opposite transverse sides of the mating hole in said cleat to allow the limited rotary motion between said cleat and said cleat support surface.

23. A cycling shoe outsole and cleat system in accordance with claim 22 wherein the degree of rotation of said cleat with respect to said cleat support surface is limited by contact between said flanges and the opposite transverse sides of said mating hole.

24. A cycling shoe outsole and cleat system in accordance with claim 23 wherein the rotation of said cleat is limited to approximately six degrees to either side of a center point of rotation.

25. A cycling shoe outsole and cleat system in accordance with claim 17 wherein said cleat includes a perimeter wall surrounding said washer, the degree of rotation of said cleat with respect to said cleat support surface being limited by contact between said perimeter wall and said washer.

26. A cycling shoe outsole and cleat system in accordance with claim 25 wherein the rotation of said cleat is limited to approximately six degrees to either side of a center point of rotation.

* * * * *